United States Patent [19]

Dodd

[11] Patent Number: 4,926,743

[45] Date of Patent: May 22, 1990

[54] QUICK RELEASE GUN MOUNT ASSEMBLY

[75] Inventor: Richard E. Dodd, Santa Ana, Calif.

[73] Assignee: North American Dynamics, Tustin, Calif.

[21] Appl. No.: 371,130

[22] Filed: Jun. 26, 1989

[51] Int. Cl.[5] ..... F41A 27/08

[52] U.S. Cl. ..... 89/40.14; 89/37.03

[58] Field of Search ..... 89/40.14, 37.07, 37.11, 89/37.03, 37.01

[56] References Cited

U.S. PATENT DOCUMENTS

| | | | |
|---|---|---|---|
| 1,209,521 | 12/1916 | Völler | 89/37.07 |
| 1,313,464 | 8/1919 | Buckham | 89/37.07 |
| 2,335,835 | 11/1943 | Zietlow | 89/37.03 |
| 2,366,704 | 1/1945 | Austin et al. | 89/37.03 |
| 2,487,062 | 11/1949 | Manes | 89/37.03 |
| 2,868,080 | 1/1959 | Meyer | 89/37.03 |
| 3,424,052 | 1/1969 | Ruf | 89/37.01 |

FOREIGN PATENT DOCUMENTS

| | | | |
|---|---|---|---|
| 465482 | 9/1951 | Italy | 89/37.01 |
| 13965 | of 1899 | United Kingdom | 89/37.07 |

*Primary Examiner*—Charles T. Jordan
*Assistant Examiner*—Michael J. Carone
*Attorney, Agent, or Firm*—Walter A. Hackler

[57] ABSTRACT

Gun mounting apparatus is provided which includes a pivotable shoe for slidably engaging a mating bracket on a gun in order to support a substantial amount of the gun weight to facilitate movement of the gun and engagement of coaxial fittings along with quick release means for both engaging the coaxial gun fittings and enabling gun rotation in elevation thereabout.

10 Claims, 3 Drawing Sheets

QUICK RELEASE GUN MOUNT ASSEMBLY

The present invention generally relates to military equipment including a turret, or the like, mounted for rotation about a vertical axis and is more specifically directed to gun mounting apparatus for fixing a gun to the turret about an elevation axis enabling rotation of the gun between a zenith position and a horizontal position.

The present invention is most particularly suited for the mounting of, for example, The McDonnell Douglas 30 mm ASP® type weapons or smaller. A 30 mm weapon, typically weighing between 115 and 140 pounds, may be mounted to a turret, or the like, in a manner enabling manual installation and removal thereof for either replacement or repair.

Heretofore available mounting assemblies for such weapons have required tedious manipulations by two or more personnel for the placement and mounting of the weapon. The weight of the gun, as well as the circumstances under which the gun may require installation or removal, provide a need for a gun mount which facilitates rapid installation and removal without the use of elaborate tools or the like.

While the need for "quick connect" gun mounting system has been recognized for sometime, heretofore designs attempting to facilitate the mounting of guns have not facilitated the mounting of guns by partially supporting the weight of the gun during final alignment and locking of the gun in pivot position for elevational movement about fittings thereon, such as a pair of coaxial trunions extending therefrom. Even minor improvements to gun mounting systems facilitating rapid installation and removal of guns is significant in view of the combat environment in which such operations take place.

The present invention provides for a quick release gun-mounting assembly enabling the installation and removal of a 30 mm size gun from a turret, or the like, by one or two personnel in the field, without the use of specialized hand tools.

SUMMARY OF THE INVENTION

In accordance with the present invention, gun-mounting apparatus includes pivotable shoe means for slidably engaging a mating bracket on the gun and for supporting a substantial amount of the gun weight to facilitate movement of the gun and engagement of coaxial gun fittings which are disposed in a spaced apart relationship with a mating bracket. In combination therewith, quick release means is provided for both engaging the coaxial gun fittings and enabling gun rotation thereabout. Thus, in accordance with the present invention, the gun may be lifted by one or more personnel into a position for engaging the mating bracket which thereafter supports the weight of the gun thereby enabling alignment of coaxial gun fittings, which may be gun trunions protruding from each side of the gun, with the quick release means.

It should be obvious that this apparatus then provides a means for more rapidly and confidently mounting of the gun, as may be necessary in combat situations, without the tedious manipulation of the gun by personnel who also must support the weight of the gun as in heretofore available gun mounts.

More particularly, in accordance with the present invention, a quick release apparatus includes cradle means for supporting a fixed outer trunion sleeve and inner trunion sleeve means, slidably supported therewithin, the latter having a socket in one end thereof, for engaging a gun trunion.

Pin means are provided in the fixed outer trunion sleeve for engaging a helical groove disposed in the inner trunion sleeve in order to cause precise axial movement of the inner trunion sleeve means as it is rotated within the fixed outer trunion sleeve from a first position at which the socket disengages a gun trunion to a second position at which the socket engages the gun trunion. In addition, means are provided for releasably locking the inner trunion sleeve means to the fixed outer trunion sleeve in the second position.

More particularly, the means for releasably locking the inner trunion sleeve means includes a plunger slidably disposed within the inner trunion sleeve means and extending outward from an opposite end therefrom. Means for defining an aperture are provided through the fixed outer trunion sleeve and through the inner trunion sleeve means with the fixed outer trunion sleeve aperture and the inner trunion sleeve means aperture being aligned when the inner trunion sleeve means is in the second position. Locking of the inner and outer trunion sleeves is provided by ball means, disposed within the inner trunion sleeve means aperture, for engaging the fixed outer trunion sleeve aperture when the inner trunion sleeve means is in the second position. In this position, the ball means is held in engagement with the outer trunion sleeve means by the plunger.

In order to release the inner-trunion sleeve means, groove means are provided in the plunger in a spaced apart reltionship with the inner trunion sleeve means aperture for receiving the ball means when the plunger is slid into a position aligning the groove means with the fixed outer trunion sleeve aperture thereby allowing the ball to disengage the fixed outer trunion sleeve aperture by moving into the groove and enabling the inner trunion sleeve means to be moved from the second position to the first position.

It should be appreciated that the hereinabove described pin, the fixed outer trunion and the helical groove disposed in the inner trunion sleeve engaged by the pin means provides the precise axial movement of the inner trunion sleeve means in order that when the inner trunion sleeve means is rotated to the second position, precise alignment of the apertures in the inner trunion sleeve and the outer trunion sleeve is established, thereby enabling the ball to lock the inner and the outer trunion sleeve means together.

In accordance with the present invention, a slot is provided in the fixed outer trunion sleeve for enabling the gun trunions to be placed into the inner trunion sleeve means socket as the inner trunion sleeve means is moved from the first to the second position. During installation, after the gun is supported by the pivotable shoe, the trunions can be easily manipulated into the slots of the outer trunion sleeve means whereafter the inner sleeve means can be manually moved from the first to the second position for engaging the gun trunions. Accordingly, the gun trunions are therefore supported by the inner sleeve means and the outer sleeve means for absorbing recoil of the gun and transmitting such forces into the cradle means for supporting the fixed outer trunion sleeve.

In the event that damage to the inter and outer trunion sleeves occurs during use thereof, means are provided for releasably attaching the fixed outer trunion means to the cradle. More particularly, the gun mounting apparatus in accordance with the present invention may include two cradles disposed in a spaced apart relationship with one another for supporting first and second trunion sleeve mean assemblies in a position for engaging the gun trunions. Each gun trunion sleeve assembly includes an inner changeable fixed outer trunion sleeve and an inner trunion sleeve, as hereinabove described.

BRIEF DESCRIPTION OF THE DRAWINGS

A better understanding of the present invention may be had from the consideration of the following detailed description, taken in conjunction with the accompanying drawings, in which.

DETAILED DESCRIPTION

Figure 1:
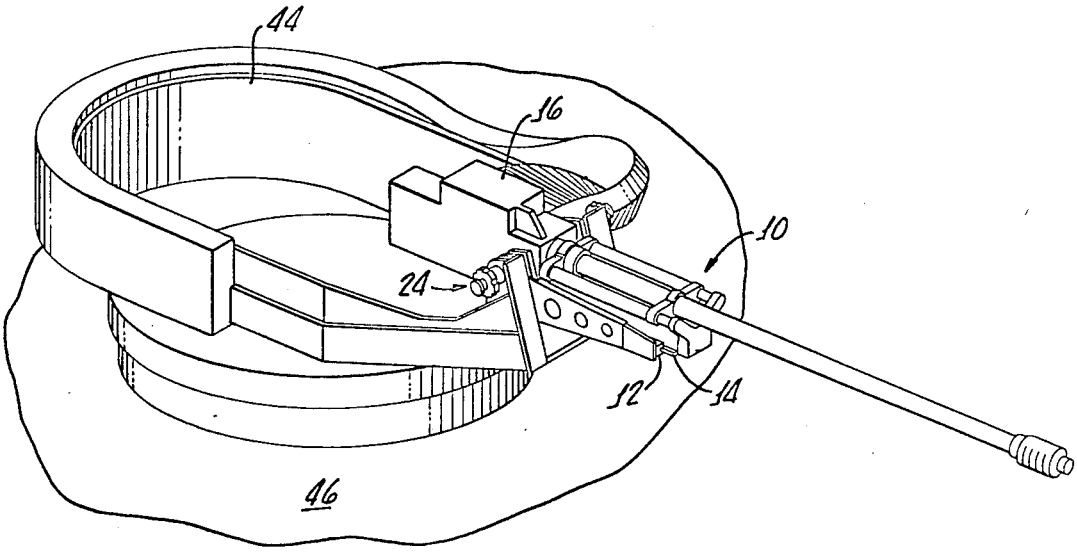
FIG. 1, is a perspective view of the present invention shown with a 30 mm type gun installed therein with the gun mounting apparatus itself being installed on a turret.
Figure 2:
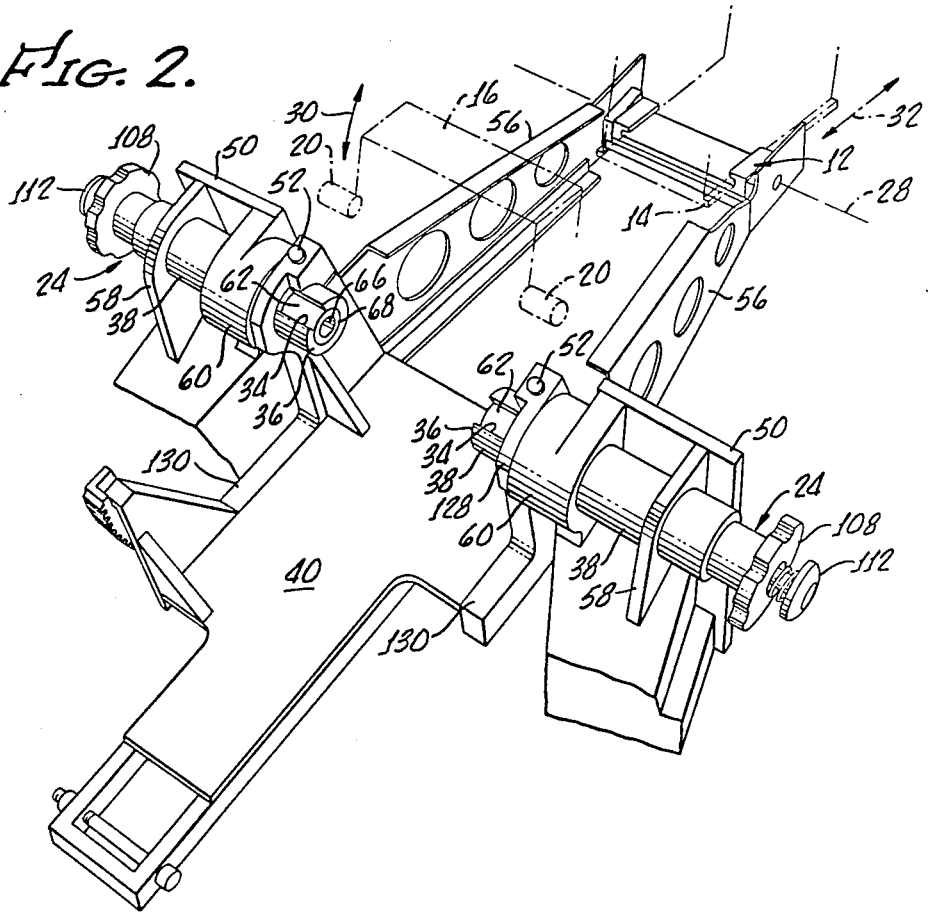
FIG. 2, is a perspective enlarged view of the present invention generally showing a pivotal shoe for slidably engaging a gun and a quick release apparatus disposed in a spaced apart relationship with the pivotal shoe.

Turning now to FIGS. 1 and 2, there is shown a gun mounting apparatus 10 generally including a pivotal shoe 12 which provides means for slidably engaging a mating bracket 14 on a gun 16 and importantly, for supporting a substantial amount of the gun 16 weight, in order to facilitate movement of the gun 16 for engagement of coaxial fittings, such as trunions 20, disposed on the gun 12 in a spaced apart relationship with the bracket 14. While trunions 20 are shown in FIG. 2, it is to be appreciated that the gun fittings may also alternatively be in the form of recesses, (not shown) coaxially aligned and disposed on either side of the gun 16 for enabling engagement of male trunions (not shown) therewith to provide an elevation axis for the gun.

Also generally shown in FIGS. 1 and 2 is quick release apparatus 24 which provides means for both engaging the gun trunions 20 and enabling elevational gun rotation thereabout as will be hereinafter described in greater detail.

An important feature is provided by the pivotal shoe 12 and the spaced apart quick release apparatus 24 in that this combination facilitates the mounting of the gun 16, which, in the case of the 30 mm ASP® having a weight of about 125 pounds, by one or two personnel without the use of specialized tools.

Heretofore, gun mounting systems required the gun to be lowered to a horizontal position for its removal and further, the total weight of the gun was supported by personnel while attempting to align the gun trunions with engagement devices. The weight of the gun of course makes this a strenuous operation and, further, under combat conditions, alignment of the trunions often became tedious, resulting in unwanted delays in a gun mounting. It can be easily appreciated that gun mounting apparatus in accordance with the present invention provides a shoe 12 mounted for pivoting about an axis 28 into which the mating bracket 14 of the gun is easily inserted. As can be appreciated in FIG. 2, once inserted, the gun 16 may be rotated about the axis 28 as indicated by the double headed arrow 30 and translationally displaced along the shoe 12 as indicated by the double headed arrow 32 in order to easily position the trunions 20 through a slot 34 in and end 38 of a fixed outer trunion sleeve 38, as will be hereinafter described in greater detail.

More particularly, in accordance with the present invention, the quick release apparatus 24 may include a cradle suitably attached to a turret 44, or the like, on a fixed or movable platform 46. As more particularly shown in FIG. 2, the cradle 40 may include a pair of upright brackets 50 which provides means for supporting fixed outer trunion sleeves 38 by means of bolts 52 as hereinafter described in greater detail.

A pair of extending arms 56 interconnect the shoe 12 and establish a spaced apart relationship between the pivotal shoe 12 and the quick release apparatus 24 which includes the fixed outer trunion sleeves 38. The cradle brackets 50 include support ribs 58, 60 for absorbing recoil forces exerted by the gun trunions 20 through an inner trunion sleeve 62, the outer trunion sleeve 38 onto the supporting turret 44. The inner trunion sleeve 62, which is slidably supported within the fixed outer trunion sleeve 38, includes a socket 66 in one end 68 which provides means for engaging the gun trunion 20.

Figure 3:
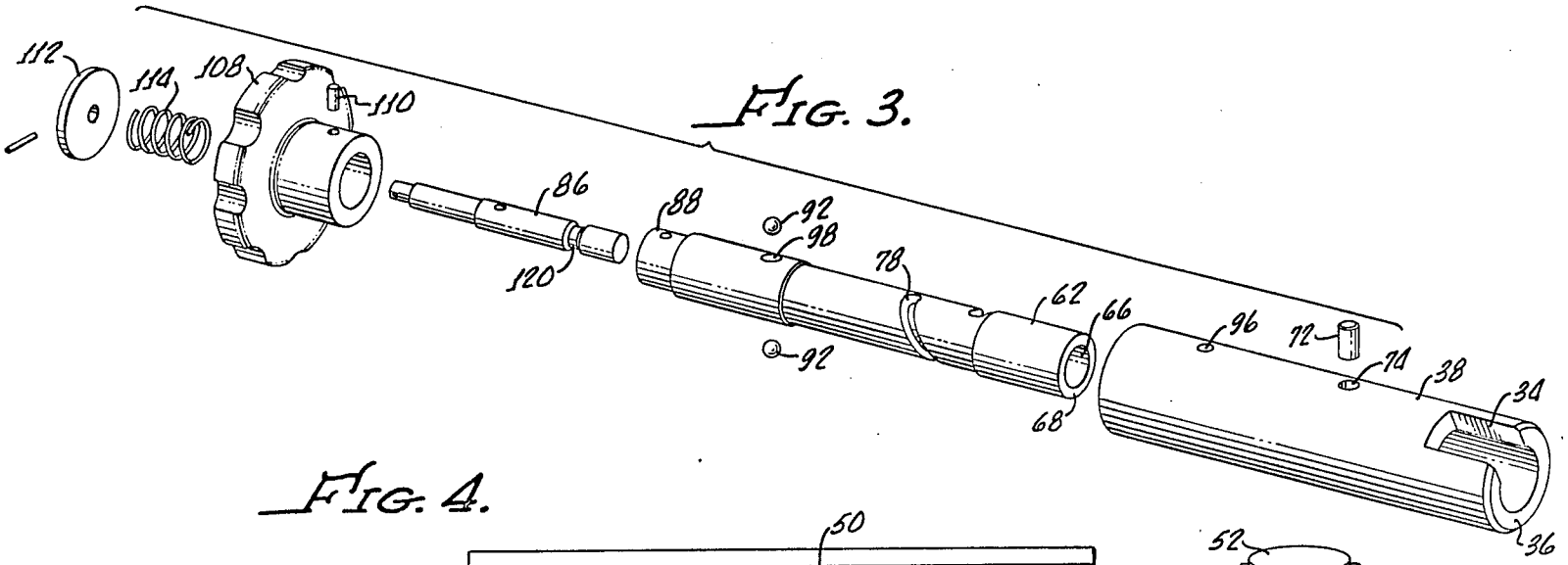
FIG. 3, is an exploded perspective view of a quick release apparatus in accordance with the present invention.

As shown in FIG. 3, a pin 72 disposed in a hole 74 of the fixed outer trunion sleeve 38 provides means for engaging a helical groove 78 in the inner trunion sleeve 62. Rotational movement of the inner trunion sleeve 62 within the outer trunion will cause precise axial movement of the inner sleeve 38 from a first position shown in FIG. 4 at which the socket 66 disengages the gun trunion 20 to a second position, shown in FIG. 5, at which the socket 66 engages the gun trunion 20. The helical groove 78 terminates in a hole 82 (FIG. 4) through the inner trunion sleeve 62 for enabling the pin 72 which is tightly fitted to the hole 74 in the outer trunion sleeve 38 to be driven therein enabling the disassembly of the inner trunion sleeve 62 from the outer trunion sleeve 38 when desired for maintenance or replacement thereof.

Figure 4:
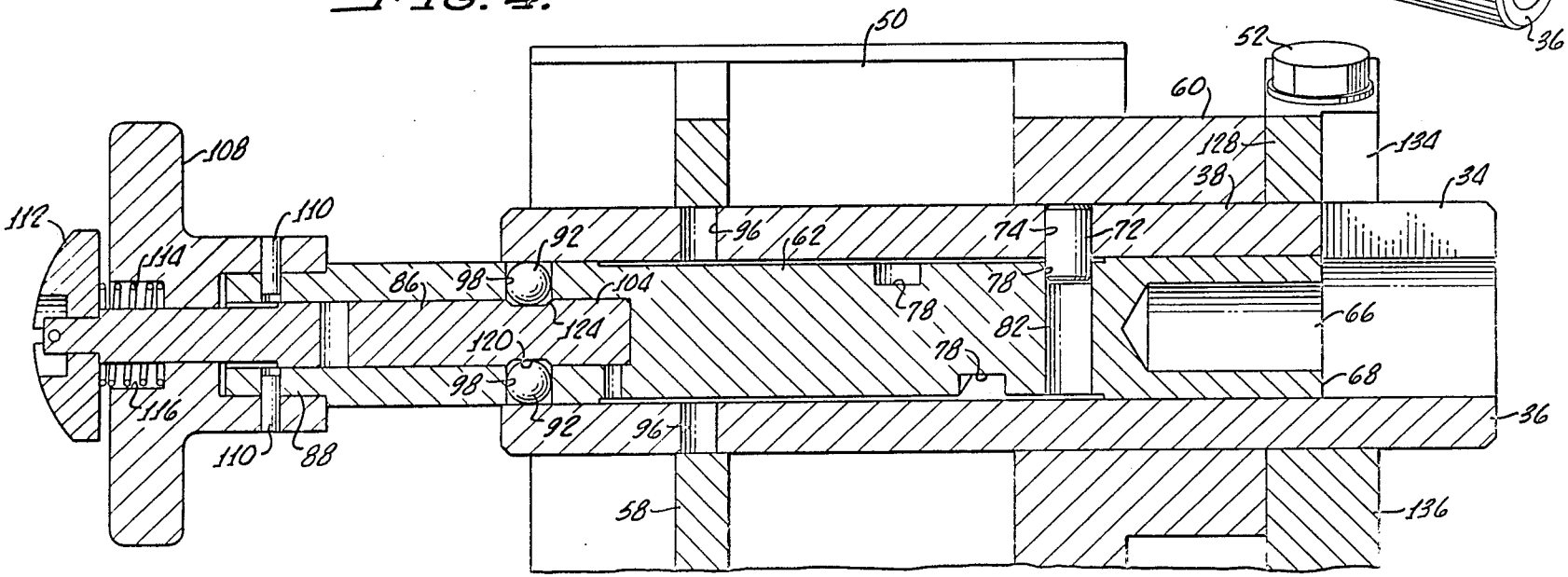
FIG. 4, is a cross-sectional view of the quick release apparatus in accordance with the present invention wherein an inner sleeve is in a first position enabling removal of the gun from the mounting apparatus.
Figure 5:
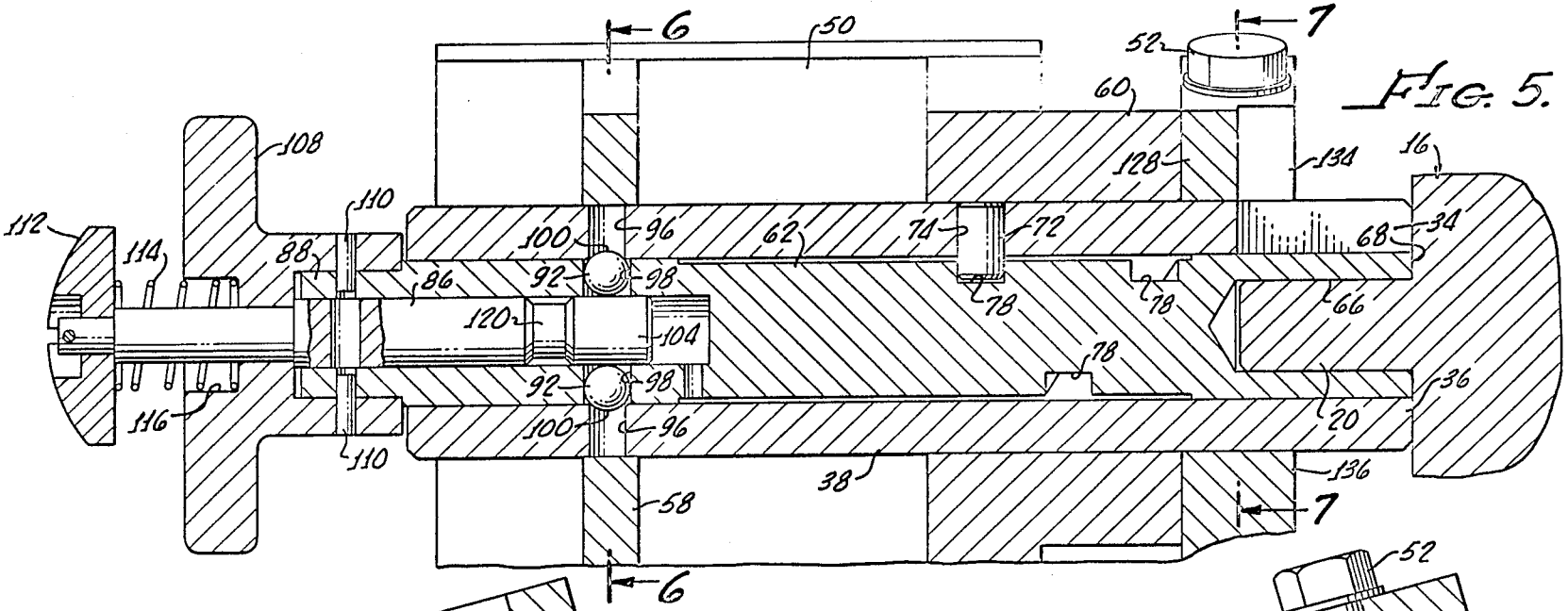
FIG. 5, is a cross-sectional view of the quick release apparatus of the present invention showing the inner sleeve in a second position for engaging a gun trunion.

A plunger 86 slidably disposed within the inner trunion sleeve 62 and extending outward from an opposite end 88 of the inner trunion sleeve along with a pair of balls 92 provides means for releasably locking the inner trunion sleeve 62 to the fixed outer trunion sleeve 38 in the second position, as shown in FIG. 5. An aperture 96 is provided through the fixed outer trunion sleeve 38 and aligned with an aperture 98 through the inner trunion sleeve when the inner trunion sleeve is in the second position. As can be seen from FIGS. 4 and 5, the balls 92 and aperture 98 are sized to permit the balls 92 to freely move therein, whereas the diameter of the aperture 96 is sufficient for enabling only a portion 100 of the ball 92 to protrude thereinto. A forward portion 104 of the plunger 86, seats the balls 92 in the apertures 96 thereby locking the inner trunion sleeve 62 to the outer trunion sleeve 38 to prevent any unwanted translational movement therebetween.

A knob 108 fitted to the opposite end 88 of the inner trunion sleeve 62 by means of (2) pins 110 provides means for manually rotating the sleeve 62, thus pulling the inner trunion sleeve 62 from the outer trunion sleeve 38 when the plunger is moved inwardly by depressing a plunger knob 112 against a spring 114 disposed within a well 116 of the handle 108 in order that a groove 120 is aligned with the balls 92. This enables the balls to drop thereinto and disengage from the aperture 96 allowing the inner sleeve 62 to be moved to a first position disengaging the socket 66 from the gun trunions 20, and thereby enabling removal of the gun from the gun mount apparatus 10, see FIG. 4.

It should be easily appreciated from FIGS. 4 and 5 that, upon remounting of the gun, when the knob 108 is rotated clockwise the inner sleeve 62 is pushed inwardly so that the socket 66 engages the gun trunion 20, the pin 72 and helical groove 78 enable precision rotational alignment so that when the inner sleeve 62 reaches the second position, the apertures 98 and 96 are aligned, thereby enabling the ball 92 to move into the aperture 96 by the force of the spring 114 moving the plunger outwardly with a ramp portion 124 of the groove 120 forcing the balls 92 into the apertures 96. Thus, no additional movement is required by personnel in order to lock the gun in position, other than rotating the knob 108 clockwise on each side of the gun mount 10.

The locking engagement of the inner trunion sleeve 62 with the outer trunion sleeve 38 by means of the apertures 98 and 96, respectively, and the balls 92, is clearly shown in cross-section which is taken along the line 6—6 of FIG. 5.

Figure 7:
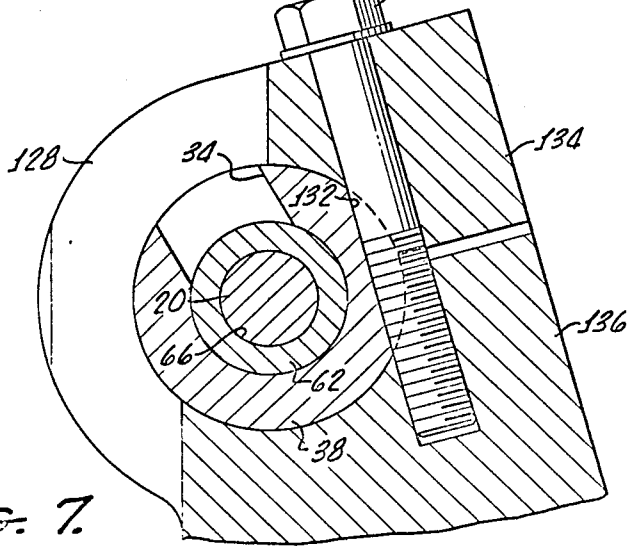
FIG. 7, is a cross-sectional view, taken along the line 7—7 in FIG. 5, showing the fixed outer sleeve with the slidable inner sleeve trunion therein fixed to a cradle.
Figure 6:
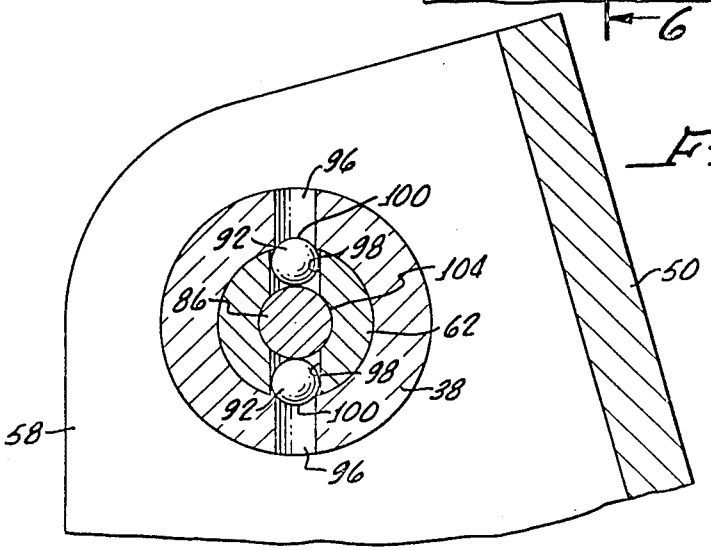
FIG. 6, is a cross-sectional view taken along the line of 6—6 of FIG. 5 showing a ball plunger arrangement for releasably locking the inner and outer trunion sleeves to one another.

As hereinbefore mentioned, the outer trunion sleeve 38 is subjected to considerable recoil forces which are passed through to the cradle brackets 50. The apparatus of the present invention includes two such outer trunion sleeves which are identical in manufacture and may be used on either side of the gun. As shown in FIG. 7, the outer trunion sleeve 38 is clamped in a circular portion of cradle rib 128 by means of the bolt 52 which passes along a flattened side 132 and compresses the outer sleeve 38 between an upper 134 and a lower 136 portion. Because the outer trunion sleeves as well as the inner trunion sleeves are identical in nature, less replacement inventory is necessary for field maintenance of the gun mount apparatus 10.

Although there has been described hereinabove gun mounting apparatus in accordance with the present invention for the purpose of illustrating the manner in which the invention may be used to advantage, it should be appreciated that the invention is not limited thereto. Accordingly, any and all modifications, variations or equivalent arrangements which may occur to those skilled in the art, should be considered to be within the scope of the invention as defined in the appended claims.

What is claimed is:

1. Gun mounting apparatus comprising:

coaxial gun fittings disposed on a gun;

a mating bracket disposed on said gun in a spaced apart relationship with said coaxial gun fittings;

quick release means for both engaging said coaxial gun fittings and enabling gun rotation thereabout; and pivotable shoe means for slidably engaging the mating bracket and for supporting a substantial amount of the gun weight in order to facilitate movement of the gun and engagement of the coaxial gun fittings with the quick release means.

2. The gun mounting apparatus according to claim 1 wherein said coaxial gun fittings comprise a pair of gun trunions protruding from each side of gun.

3. The gun mounting apparatus according to claim 2 wherein said quick release means comprises:

cradle means for supporting a fixed outer trunion sleeve;

inner trunion sleeve means, slidably supported within said fixed outer trunion sleeve having a socket in one end thereof for engaging a gun trunion;

pin means disposed in said fixed outer trunion sleeve, for engaging a helical groove disposed in said inner trunion sleeve means in order to cause precise axial movement of said inner trunion sleeve means as it is rotated within said fixed outer trunion sleeve from a first position at which said socket disengages the gun trunion to a second position at which said socket engages the gun trunions; and means for releasably locking said inner trunion sleeve means to said fixed outer trunion sleeve in said second position.

4. The gun mounting apparatus according to claim 3 wherein said means for releasably locking said inner trunion sleeve means comprises:

a plunger slidably disposed within said inner trunion sleeve means and extending outward from an end thereof;

means for defining an aperture through said fixed outer trunion sleeve;

means for defining an aperture through said inner trunion sleeve means, the fixed outer trunion sleeve aperture and the inner trunion sleeve means aperture being aligned when said inner trunion sleeve means is in said second position;

ball means disposed within the inner trunion sleeve means aperture for engaging the fixed outer trunion sleeve aperture when said inner trunion sleeve means is in said second position, said ball means being held in engagement with the fixed outer trunion sleeve aperture by said plunger; and groove means disposed in said plunger in a spaced apart relationship with the inner trunion sleeve means aperture for receiving said ball means when said plunger is slid into a position aligning said groove means with the fixed outer trunion sleeve aperture to unlock the inner trunion sleeve means for the fixed outer trunion sleeve and enable the inner trunion sleeve means to be moved from the fixed position to the first position.

5. The gun mounting apparatus according to claim 4 further comprising means defining a slot in said fixed outer trunion sleeve, for enabling said gun trunion to be placed into said inner trunion sleeve means socket as the inner trunion sleeve means is moved from the first to the second position.

6. The gun mounting apparatus according to claim 5 further comprising means for releasably attaching said fixed outer trunion sleeve to said cradle means.

7. The gun mounting apparatus according to claim 2 further comprising two cradle means, disposed in a spaced apart relation, for supporting first and second trunion sleeve assembly in a position for engaging the gun trunion.

8. The gun mounting apparatus according to claim 7 wherein each trunion sleeve assembly comprises interchangeable fixed outer trunion sleeve and interchangeable inner trunion sleeve means, each slidably supported within a fixed outer trunion sleeve for engaging a gun trunion.

9. The gun mounting apparatus according to claim 8 wherein said quick release means comprises:

cradle means for supporting a fixed outer trunion sleeve;

inner trunion sleeve means, slidably supported within said fixed outer trunion sleeve having a socket in one end thereof for engaging a gun trunion;

pin means disposed in said fixed outer trunion sleeve, for engaging a helical groove disposed in said inner trunion sleeve means in order to cause precise axial movement of said inner trunion sleeve means as it is rotated within said fixed outer trunion sleeve from a first position at which said socket disengages the gun trunion to a second position at which said socket engages the gun trunions; and means for releasably locking said inner trunion sleeve means to said fixed outer trunion sleeve in said second position.

10. The gun mounting apparatus according to claim 9 wherein said means for releasably locking said inner trunion sleeve means comprises:

a plunger slidably disposed within said inner trunion sleeve means and extending outward from an end thereof;

means for defining an aperture through said fixed outer trunion sleeve;

means for defining an aperture through said inner trunion sleeve means, the fixed outer trunion sleeve aperture and the inner trunion sleeve means aperture being aligned when said inner trunion sleeve means is in said second position;

ball means disposed within the inner trunion sleeve means aperture for engaging the fixed outer trunion sleeve aperture when said inner trunion sleeve means is in said second position, said ball means being held in engagement with the fixed outer trunion sleeve aperture by said plunger; and groove means disposed in said plunger in a spaced apart relationship with the inner trunion sleeve means aperture for receiving said ball means when said plunger is slid into a position aligning said groove means with the fixed outer trunion sleeve aperture to unlock the inner trunion sleeve means for the fixed outer trunion sleeve and enable the inner trunion sleeve means to be moved from the fixed position to the first position.

* * * * *